United States Patent [19]

Horbaschek

[11] Patent Number: 4,712,226

[45] Date of Patent: Dec. 8, 1987

[54] STEREOSCOPIC X-RAY TUBE

[75] Inventor: Heinz Horbaschek, Erlangen, Fed. Rep. of Germany

[73] Assignee: Siemens Aktiengesellschaft, Berlin and Munich, Fed. Rep. of Germany

[21] Appl. No.: 886,081

[22] Filed: Jul. 16, 1986

[30] Foreign Application Priority Data

Sep. 13, 1985 [DE] Fed. Rep. of Germany ..... 3532822

[51] Int. Cl.[4] ..... H01J 35/06

[52] U.S. Cl. ..... 378/134; 378/41; 378/124; 378/144

[58] Field of Search ..... 378/41, 42, 124, 134, 378/143, 144, 157

[56] References Cited

U.S. PATENT DOCUMENTS

| | | | |
|---|---|---|---|
| 1,995,054 | 3/1935 | Chambers | 378/42 |
| 3,229,089 | 1/1966 | Sasao | 378/157 |
| 3,250,916 | 5/1966 | Rogers et al. | 378/41 |
| 3,329,847 | 7/1967 | Friedman | 378/144 |
| 4,048,496 | 9/1977 | Albert | 378/45 |
| 4,287,420 | 9/1981 | Yamamura et al. | 378/41 |

FOREIGN PATENT DOCUMENTS

| | | |
|---|---|---|
| 0062219 | 10/1982 | European Pat. Off. . |
| 0102869 | 3/1984 | European Pat. Off. . |
| 2157843 | 6/1973 | Fed. Rep. of Germany . |
| 3112016 | 10/1982 | Fed. Rep. of Germany . |
| 2034967 | 6/1980 | United Kingdom . |
| 2133208 | 7/1984 | United Kingdom . |

OTHER PUBLICATIONS

Siemens Data Sheet for Stereolix ®.

*Primary Examiner*—Craig E. Church
*Assistant Examiner*—John C. Freeman
*Attorney, Agent, or Firm*—Hill, Van Santen, Steadman & Simpson

[57] ABSTRACT

A stereoscopic x-ray tube has an evacuated housing with a motor-driven anode dish therein, as well as at least two cathodes. The cathodes are disposed for directing electrons onto two respective foci within at least one track of the anode dish. Each of the foci generates a beam of useful x-rays, the two beams alternating. The anode dish is divided into at least one pair of segments of identical size, each segment emitting x-rays of a different intensity, so that only one segment in each pair can emit useful x-rays. The cathodes are disposed such that their respective foci are spaced at an uneven multiple of the length of the track within a segment.

7 Claims, 3 Drawing Figures

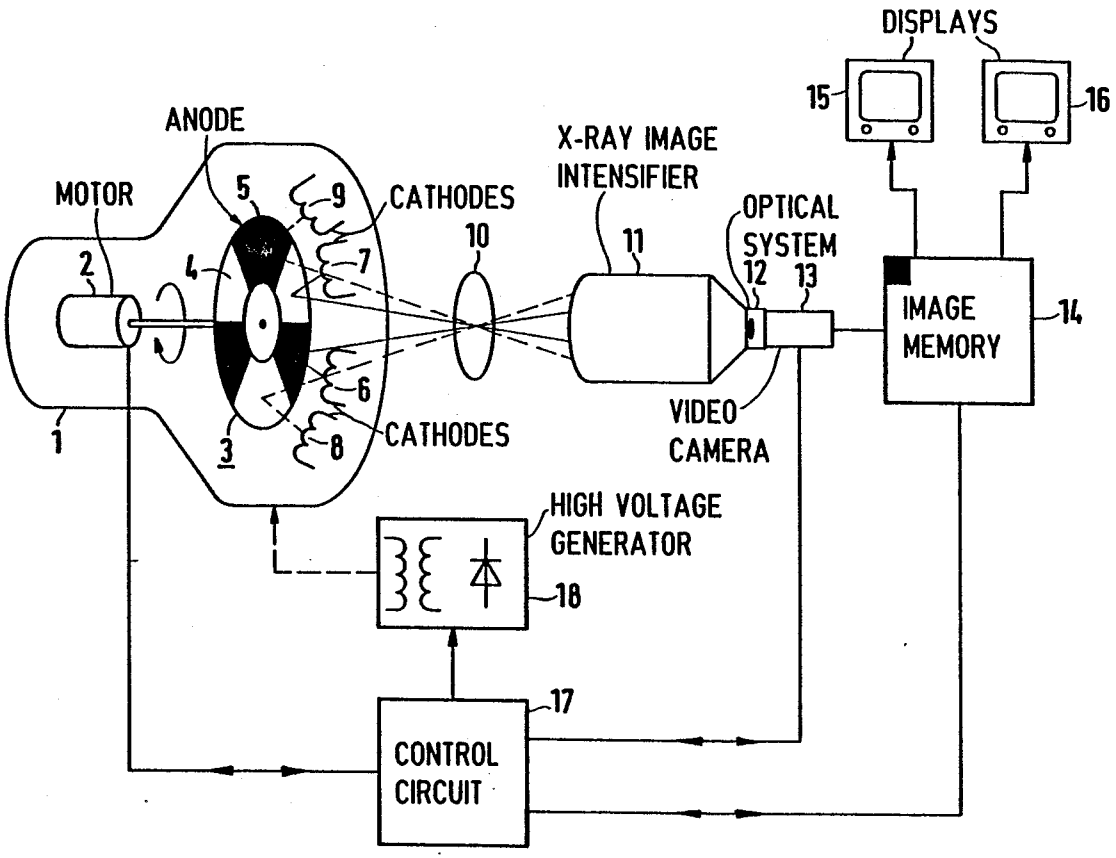
DISPLAYS
16
15
IMAGE MEMORY
14
OPTICAL SYSTEM
12
13
VIDEO CAMERA
X-RAY IMAGE INTENSIFIER
11
HIGH VOLTAGE GENERATOR
18
17
CONTROL CIRCUIT
CATHODES
10
CATHODES
9
7
6
8
ANODE
5
4
3
MOTOR
2
1

STEREOSCOPIC X-RAY TUBE

BACKGROUND OF THE INVENTION

. Field of the Invention

The present invention relates to rotary x-ray tubes, and in particular to such an x-ray tube for producing stereo x-ray exposures.

2. Description of the Prior Art

Stereoscopic x-ray tubes are known in the art generally including an evacuated housing having a motor-driven anode therein, and at least two cathodes which are directed to at least two foci within at least one track of the anode dish disc or plate. Two alternating beams of useful x-rays are thereby generated and directed toward an examination subject. For generating stereo x-ray exposures, the spacing between the foci may, for example, correspond to the distance between the pupils of an average viewer. X-ray exposures produced in this manner are then observed with a reproduction means for stereo images.

A stereo x-ray system is described in German Pat. No. 21 57 843, corresponding to U.S. application Ser. No. 302,546 filed Oct. 31, 1972 (Duemmling), now abandoned. This system includes two separate x-ray tubes disposed at a slight distance next to each other, which are alternately supplied with high voltage. The minimum possible spacing of the two foci is thus determined by the tube dimensions, and thus frequently cannot be selected small enough. A substantial circuit outlay is also required, given a high frame frequency, because the two x-ray generators are necessary and must be alternatingly switched.

A stereo tube is also described in a data sheet published by Siemens AG for its Stereolix ®Unit wherein the foci are broght to the two different positions required for stereo imaging by means of mechanical motion of a single cathode. The frame frequency is limited in this unit by the inertia of the motion.

When higher frame frequencies are required, an x-ray tube having a plurality of cathodes must be employed. The cathodes are alternatingly switched by means of a grid control as described in German OS No. 14 89 114, corresponding to U.S. Pat. No. 3,250,916. This arrangement also requires considerable circuit outlay because the control voltages, given the symmetrical high-voltage of the x-ray tubes which is normally employed, must be greater than one half of the high-voltage.

A computer tomograph system is described in German OS No. 31 12 016 wherein a plurality of slices can be simultaneously transilluminated and wherein a plurality of focal points in different anode tracks are generated on the anode dish, with an x-ray beam proceeding from each focal point. Only one detector row is provided for acquiring the x-rays. In order for a corresponding allocation of the output signals of the detector row to be made, the focal point tracks on the anode dish are in the form of segments consisting of a material which does not emit x-radiation, such as plastic. A periodic, chronologically coded interruption of the x-ray beam is thereby achieved, with every x-ray beam associated with a particular slice being given a different coding. The association of an output signal of the detector row with a given slice can be subsequently identified by the coding, so that the signals can be separately stored. A periodically alternating, uniform switching of two x-ray beams required for stereo techniques is not achieved by this system.

SUMMARY OF THE INVENTION

It is an object of the present invention to provide a stereoscopic x-ray tube wherein a plurality of foci can be generated by plurality of cathodes and the useful x-radiation of a cathode pair is alternatingly switched without the necessity of grid control or oscillatory cathode movement.

The above object is achieved in accordance with the principles of the present invention in an x-ray tube having an anode dish divided into at least one pair of segments of identical size, the segments emitting x-rays in a direction toward an examination subject with different intensity, so that only one segment of the pair can emit useful x-rays. The cathodes are disposed such that their respected foci are spaced at an uneven multiple of the length of the track which the foci would travel within a segment. Due to rotation of the anode dish, the foci alternatingly emit an x-ray beam, because the cathodes are alternatingly successively directed onto a segment of the anode dish which is capable of emitting useful x-rays.

A reliable switching of the useful x-rays, and simultaneous reduction of stray x-rays, is achieved if the segments consist of different materials which emit x-rays with different respective intensities. The anode dish for the stereo x-ray tube can be manufactured in a simple manner by inclining the tracks within the segment at different angles, so that the x-ray beam is emitted in different directions. The x-ray beam of one segment is filtered by a corresponding diaphragm at the x-ray tube, or by a primary radiation diaphragm at the housing, and only the useful x-rays are permitted to pass.

In a further embodiment of the invention, the anode dish is subdivided into three segment pairs. The base width for stereo exposures can be varied if two cathode pairs are provided, a first pair thereof having a spacing relative to each other equal to the length of the track, and a second pair thereof having a space relative to each other of three times the length of the track. One cathode can be eliminated if three cathodes are provided with the distance between a first cathode and a second cathode being equal to the length of the track, and the distance between the first cathode and a third cathode being three times the length of the track.

DESCRIPTION OF THE DRAWINGS

FIG. 1 is a schematic block diagram of a stereoscopic x-ray system constructed in accordance with the principles of the present invention.

FIG. 2 is a side view of a further embodiment of an anode dish for use in the system of FIG. 1.

FIG. 3 is a plan view of the anode dish shown in FIG. 2.

DESCRIPTION OF THE PREFERRED EMBODIMENTS

An x-ray system employing an x-ray tube constructed in accordance with the principles of the present invention for generating stereoscopic x-ray images is shown in FIG. 1. The system includes an x-ray tube having an evacuated housing 1 in which an anode 3 and a motor 2 for rotating the anode 3 are disposed. The surface of the anode dish 3 is divided into a plurality of segments, such as segment 4 and 5, respectively consisting of materials emitting x-rays with different intensities. The segment 5 of the segment pair may, for example, consist of plastic or ceramic, which do not emit any x-radiation or only neglibibly slight x-radiation, whereas the other segment 4 may consist of material standard for anode dishes such as, for example, tungsten, molybdenum and graphite.

Alternatively, in order to achieve emissions of x-rays of different intensities, the segments of a segment pair of the anode dish 3 may be inclined at different angles, such as segments 20 and 21 in FIGS. 2 and 3 so that the segments emit x-ray beams in different directions. If the x-ray beam of the segment 20, for example is filtered out by a diaphragm (not shown) at the x-ray tube or at the housing of the x-ray system, useful x-radiation will be emitted only from segment 4. The anode dish 3 is rotated on a shaft 22.

A plurality of cathodes 6, 7, 8 and 9 are also provided, at least the heating coils of those cathodes being disposed within the housing 1 and being respectively directed onto the anode dish 3. For operation of the stereo x-ray installation, either the cathode pair 6 and 7 or, for a broader stereo base the cathode pair 8 and 9, is heated. Electron beams generated by the heated cathodes are incident on the anode dish 3 within the focal point. If the focal point of the cathode 8, for example, is on a segment such as segment 4, a beam of useful x-rays is generated. The spacing between respective focal points for the two cathodes in a cathode pair corresponds to an uneven multiple of the length of the track which the focal point describes on the anode dish 3 within a segment 4 or 5 (or 20 or 21). This, if the focal point for the cathode 8 lies on a segment 4 (or 20), the focal point for the other cathode 9 in the cathode pair will lie within the segment 5, so that no useful x-radiation is emitted at that focal point. When the anode dish 3 rotates further, the focal point for the first cathode 8 proceeds onto a segment 5 (or 21), and the focal point for the cathode 9 proceeds onto a segment 4 (or 20), so that useful x-rays are now emitted from the focal point associated with the cathode 9. If the focal points are disposed on different tracks on the anode dish 3, the spacing corresponds to a mean value of the two track lengths, thus guaranteeing that a focal points will be disposed in the same section of a segment 4 or 5.

As a result, x-rays are alternatingly generated at intervals. The x-rays penetrate an examination subject 10 and generate radiation images on the input luminescent screen of an x-ray image intensifier 11. The visible image on the output luminescent screen of the x-ray image intensifier 11 is directed onto a video camera 13 by a suitable optical system 12. The video signal from the video camera 13 is entered in an image memory 14 for at least two video images. The output signal of the memory 14 can be viewed on a stereo viewing means which may consist, for example, of two video monitors 15 and 16. The monitors may be viewed by converging type glasses such as described in the aforementioned German Pat. No. 21 57 843.

A control circuit 17 is connected to the motor 2 of the x-ray tube, the video camera 13 and the image memory 14. The control circuit 17 synchronizes the speed of the motor 2 and thus the frame frequency of the stereo images, the sampling thereof by the video camera 13, and the storage of the output signals in the image memory 14. This can be undertaken either by synchronizing rotation of the anode dish 3 or, if the anode dish 3 has a defined angular frequency, the radiation can be detected or the position of the anode dish 3 may be identified and either signal may be used to control the pick-up and reproduction frequency of the video camera 13. In the digital image memory 14, the alternating video images are processed into two independent continuous video signals for the monitors 14 and 15 for stereo observation.

A high voltage generator 18 is also connected to the control circuit 17. The high voltage generator is connected to the anode dish 3 and the cathodes 6 through 9 in a known manner, schematically indicated, for supplying these components with the required high voltages.

By varying the plurality of segment pairs 4 and 5 (or 20 and 22) on the anode dish 3 and by varying the arrangement of the several cathodes 6 though 9, different base widths as well as different ranges in the frame frequency can be achieved. The reduction of the power in the x-ray tube caused by segmentation of the anode dish 3 can be compensated by making the diameter of the anode dish 3 larger than in conventional x-ray tubes. In addition to switching of the x-ray beams by the segments 4 and 5 of the anode dish 3, the high-voltage supplied by the generator 18 may also be switched, so that exposure time can also be varied.

Although modifications and changes may be suggested by those skilled in the art it is the intention of the inventor to embody within the patent warranted hereon all changes and modifications as reasonably and properly come within the scope of his contribution of the art.

I claim as my invention:

1. An x-ray system having a stereoscopic x-ray tube to direct x-rays toward an examination subject, said stereoscopic x-ray tube comprising:

an evacuated housing;

an anode dish disposed in said housing divided into at least one pair of segments of identical size, each segment in a segment pair emitting x-radiation, means for enabling only one segment in a segment pair to substantially emit x-radiation toward said examination subject;

at least two cathodes, wherein each cathode comprises a coil disposed in said housing, each coil having a focus associated therewith on said anode dish, the foci on said anode dish being spaced at a distance corresponding to an uneven multiple of the length of a track, which said focus would follow, within one of said segments; and means for rotating said anode dish.

2. An x-ray system as claimed in claim 1, wherein said means consists of having said segments in a segment pair consist of different materials.

3. An x-ray system as claimed in claim 1, wherein said means comprises having said track within each segment of a segment pair, inclined at a different angle with respect to a neighboring segment track.

4. An x-ray system as claimed in claim 1, wherein said anode dish is divided into three segment pairs.

5. An x-ray system as claimed in claim 1, having two cathode pairs, a first of said cathode pairs having respective foci spaced relative to each other at a distance corresponding to the length of said track on said anode dish, and a second of said cathode pairs having respective foci spaced at a distance relative to each other corresponding to three times the length of said track.

6. An x-ray system as claimed in claim 1, having four cathodes, arranged in two cathode pairs.

7. An x-ray system as claimed in claim 5, having three cathodes, the distances between the respective foci of a first cathode and a second cathode corresponding to said length of said track, and the distance between the respective foci of said first cathode and a third cathode corresponding to three times the length of said track.

* * * * *